US006802086B1

(12) United States Patent
Hudzinski

(10) Patent No.: US 6,802,086 B1
(45) Date of Patent: Oct. 12, 2004

(54) HANGING COVER SUPPORT APPARATUS

(76) Inventor: Len Hudzinski, Site 450, Box 1, Comp. 2, R.R. 2 Drayton Valley, Alberta T7A 2A2 (CA)

( * ) Notice: Subject to any disclaimer, the term of this patent is extended or adjusted under 35 U.S.C. 154(b) by 0 days.

(21) Appl. No.: 10/601,588

(22) Filed: Jun. 24, 2003

(51) Int. Cl.[7] ..... E04H 4/00
(52) U.S. Cl. ..... 4/498
(58) Field of Search ..... 4/498, 580; 220/817–819, 220/831, 832

(56) References Cited

U.S. PATENT DOCUMENTS 4,991,238 A 2/1991 Forrest
5,471,685 A 12/1995 Cross
5,644,803 A 7/1997 Wilson
5,689,841 A * 11/1997 Black et al. ..... 4/498
5,819,332 A 10/1998 Perry
6,032,305 A * 3/2000 Tedrick ..... 4/498
6,381,766 B1 5/2002 Perry
6,393,630 B1 * 5/2002 Tedrick ..... 4/498
6,550,077 B1 4/2003 Tedrick

* cited by examiner

*Primary Examiner*—Gene Mancene
*Assistant Examiner*—Khoa Huynh
(74) *Attorney, Agent, or Firm*—Sean W. Goodwin

(57) ABSTRACT

A support apparatus for a cover adapted for use with a conventional cover lifting device comprises one or more brackets for engaging the peripheral edge and at least one tension member or strap extending between the crossbar of the lifting device and the bracket. Where the cover has two planer surfaces joined at a hinge for hanging over the crossbar, each strap and each bracket is are sandwiched between the covers folded surfaces and each bracket is preferably "T"-shaped for engaging the peripheral edges of both surfaces. Preferably, the length of the strap is adjustable. The weight of the cover is supported by the bracket and strap to the crossbar rather than through the hinge or fabric connection to the crossbar.

16 Claims, 11 Drawing Sheets

Fig 8b, PRIOR ART

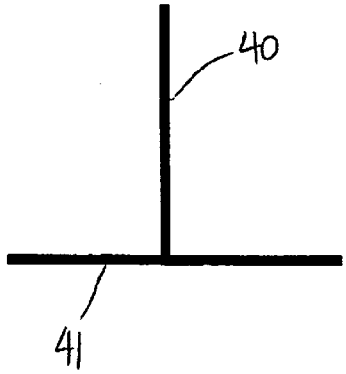
Fig 9a
Fig 9b
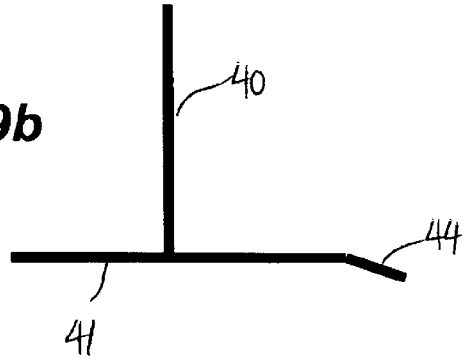
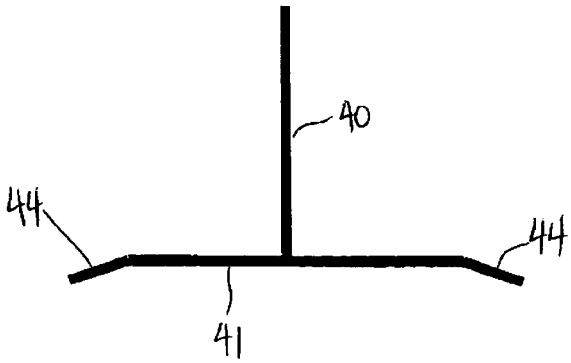
Fig 9c

HANGING COVER SUPPORT APPARATUS

FIELD OF THE INVENTION

The present invention generally relates to apparatus to suspend and support a hanging cover using tension members extending to a lower edge of the cover so as to relieve stress on the cover and more particularly to hanging supports at an upper edge of the hanging cover.

BACKGROUND OF THE INVENTION

Hot tubs or spas have long been used by people for relaxation and physical therapy. It is desirable that dirt, leaves and other types of debris be prevented from falling into the water. Additionally, since spas are heated for normal use, it is important to reduce the heat lost from the heated water to the cooler surroundings not only to conserve energy, but to save on energy costs to the user. Accordingly, a spa cover is used and is generally sized and configured to completely cover the open area of the spa. To minimize heat loss, the covers are typically constructed of an insulating material, such as foam, and are covered by a water-resistant material or fabric such as vinyl. The covers are commonly partitioned into two sections joined by a stitched seam forming a hinge so as to allow the cover to fold in half and, thereby, facilitate handling and storage.

Damage to the spa cover, and specifically the stitching, can occur over time due to stress from the removal and supporting processes. The cost of repair to a tom seam can often exceed the cost of a new cover.

Contributing to the damage to the cover are devices used for lifting spa covers which generally incorporate a means for supporting the spa cover when removed from the spa. Typically, the spa cover folds over a crossbar of the lifting device and once displaced from the spa, the cover is supported by hanging the cover over the crossbar by the hinge adjacent the spa. The full weight of the spa cover on the hinge results in stress to the stitching in the hinge and decreases the service life of the spa cover.

Many spa cover lifting and supporting devices utilizing crossbars are known in the art. U.S. Pat. No. 5,131,102 to Salley et al teaches a device wherein a crossbar is supported by two side arms and is pivotally attached to a base. A spa cover folds over the crossbar, and the crossbar, along with the supported cover, is pivoted clearly away from, and adjacent the spa. The spa cover hangs by its fabric hinge over the crossbar in a near vertical position adjacent and to the side of the spa.

Others use a discontinuous crossbar, simply to members which protrude only partially across the cover. For example, U.S. Pat. No. 5,517,703 to Ouelette, U.S. Pat. No. 5,566,403 to Black et al, U.S. Pat. No. 5,584,081 to Ouelette, and U.S. Pat. No. 5,634,218 to Ouelette are typical of this form of lifter. Nevertheless, each of these style of prior art lifters still rely on hanging the cover by its hinge when lifted and set aside Others have attempted to support spa covers in alternate methodology with relying on the hinge seam. For example, U.S. Pat. No. 4,991,238 to Forrest does not incorporate a crossbar, and instead teaches a device comprising a support frame adjacent to a spa onto which a folded spa cover may be slid in coplanar relationship to the top of the spa. One the cover is received, the frame rotates to lower the edges of the cover and acts like a cradle to support the cover. Another form is of cover removal apparatus is in U.S. Pat. No. 5,819,332 to Perry which teaches permanently connecting pivoting side arms to the cover adjacent the cover's hinge and at pivots to the spa. Further, a back rack is pivotally connected between one peripheral edge of the cover and the adjacent side of the spa so as to rotate downwardly with the cover and supports the weight of that side of the cover.

Accordingly, there is a need for a support apparatus adapted to a simple crossbar lifting apparatus which alleviates stress placed on the cover or cover hinge when the cover is supported in a near vertical position and this is easy to use. The apparatus should also be non-invasive to the spa cover, be easy to install, low cost, adjustable and adaptable to the most commonly available spa lifting apparatus.

SUMMARY OF THE INVENTION

A support apparatus for a cover is adapted for hanging covers without subjecting the fabric to excessive stress. In a preferred embodiment of the invention as applied to a cover having two surfaces foldable in half at a hinge and supported over a crossbar, brackets are provided for engaging lower peripheral edges of the two surfaces and the brackets are connected or suspended from the crossbar using tension members such as straps so as to suspend or lift the hinge clear of the crossbar. Note that herein the term crossbar refers to continuous and discontinuous members which extend entirely or partially across a cover.

In one embodiment, the apparatus comprises: at least one engaging means having at least one "T"-shaped support member for engaging first and second peripheral edges of the cover when the cover is hung in a lifted, substantially upright position. Further, one or more tension means are adapted to connect between the crossbar and the engaging means. The length of the tension means ensures that the hinge or other fabric connector at the top of the cover is positioned above the crossbar and thus remains un-stressed.

In combination with a conventional cover lifting device, a folding cover is supported over a crossbar, the crossbar being supported by two side arms rotatable about pivots. The side arms extend only so far as to position the crossbar parallel to and intermediate of the cover edges and short of the hinge. Preferably straps extend from the crossbar and along the cover to a bracket affixed to an edge of the cover. The cover lifter rotates the crossbar and cover to a lifted, substantially upright position. The weight of the cover is supported by the straps connected between the crossbar and the bracket, rather than by a contact point of the crossbar to the cover's hinge.

Accordingly, in a broad aspect, apparatus for supporting a cover comprises: engaging means for supporting and releasably engaging first and second planer surfaces of the cover adjacent peripheral edges; and tension means connected between the crossbar and the engaging means for supporting the cover with a hinge of the first and second planer surfaces being spaced above the crossbar in a substantially stress free state.

Preferably, the cover is a spa cover comprising two halves separated by a hinge seam and preferred tension means are nylon straps with T-shaped brackets engaging the lower peripheral edges of the cover. The straps are adjustable to permit adjustment and adaptation to the most commonly available spa cover lifting apparatus. Additionally, the brackets are removeably affixed to one of the surfaces of the cover so as to better retain the support apparatus to the cover when the apparatus is not actively supporting the cover.

BRIEF DESCRIPTION OF THE DRAWINGS

FIG. 2*b* is a partial side view of the cover in a resting position;

FIG. 2*c* is a partial side view of the cover being folded in half for lifting by the lifting device;

FIG. 2*d* is a partial side view of the cover folded in half to sandwiching the crossbar therebetween;

FIG. 2*e* is a partial side view of the cover in a lifted and supported position adjacent one side of the spa, the two sides of cover being supported from lower peripheral edges using the bracket and tension strap of FIG. 2*a;*

FIGS. 8*a* and 8*b* are side views illustrating a prior art lifter and single side planer cover suspended from a hanging connector.

FIGS. 9*a*–9*c* are side views of alternate embodiments of the engaging means, including a base without contouring or bent away distal ends; a base with one distal end bent away; and a base with two distal ends bent away.

DETAILED DESCRIPTION OF THE PREFERRED EMBODIMENT

Figure 1:
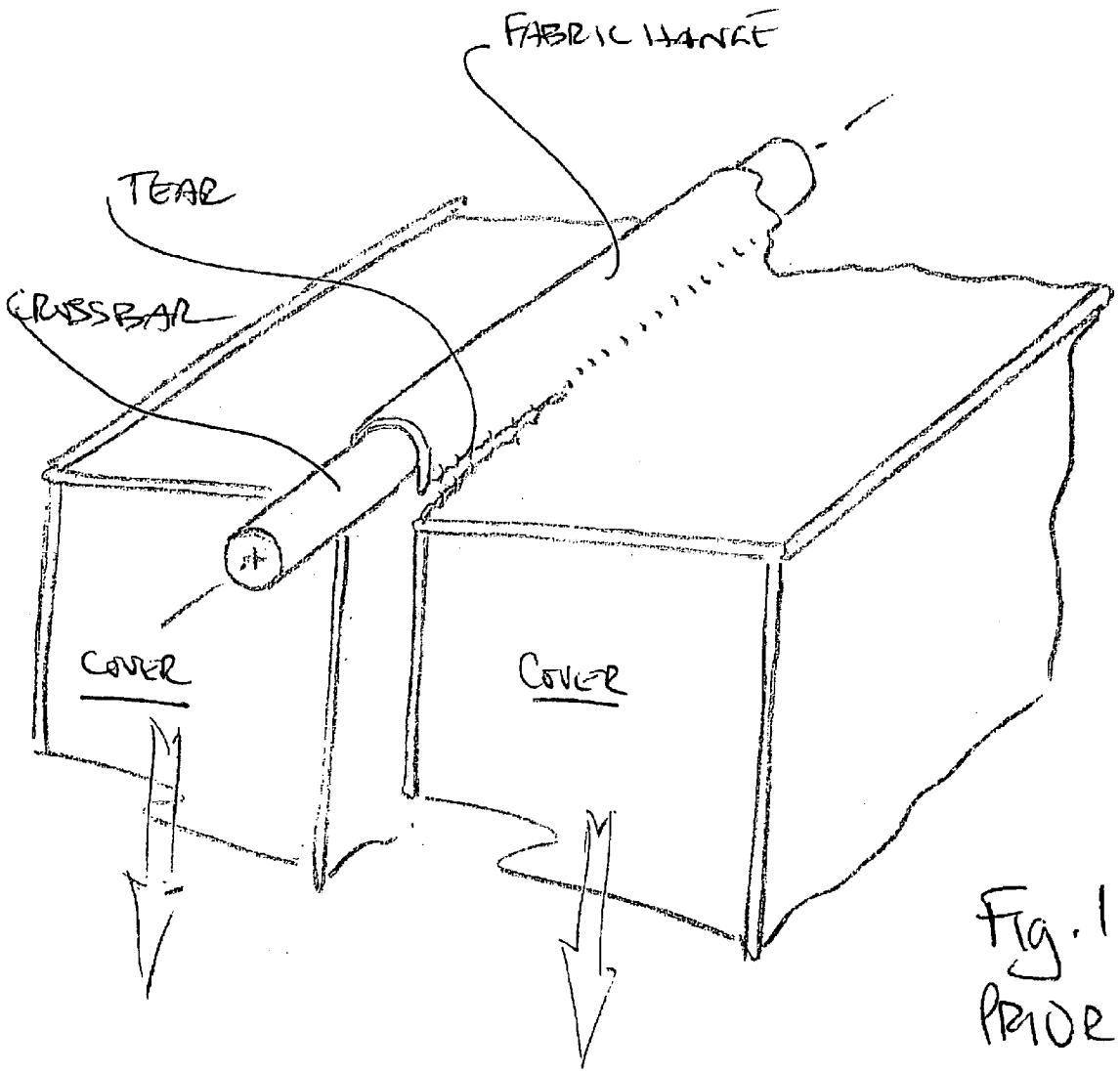
FIG. 1 PRIOR ART
FIG. 1 is a perspective, partial view of a damaged fabric hinge of a cover hung over a crossbar in the fashion of the prior art

With reference to FIG. 1, weight of a cover can be supported from some form of crossbar through fabric tabs or a fabric hinge between adjacent sides of a multi-surface cover. Over time, the fabric or seams securing the fabric to the covers surfaces can tear under the stress of the weight of the cover surfaces. The present invention relieves the stress on such fabric components.

Covers are typically displaced between two positions, a resting position covering some area or opening of particular interest, and a supported position displaced from the opening. Fabric covers are typically supported for the protection of the cover or the surrounding area.

Turning to an embodiment of the invention and with reference to FIGS. 2*a*–2*e*, a fabric or fabric-encased cover 10 is illustrated resting in place over an area of interest, such as a hot tub or spa 11. The cover is preferably supported through means engaging at a lower portion or beneath the cover rather than by hanging the cover from damage-susceptible supports, such as a fabric connector or hinge fastened by a seam to the cover. As illustrated, the present invention is described in the context of a cover 10 for a spa. It is understood, however that the support apparatus is of broad application and works as well for supporting a cover or lid of other areas of interest such as containers in which the cover is better served by supporting them with means other than by hanging.

Figure 2A:
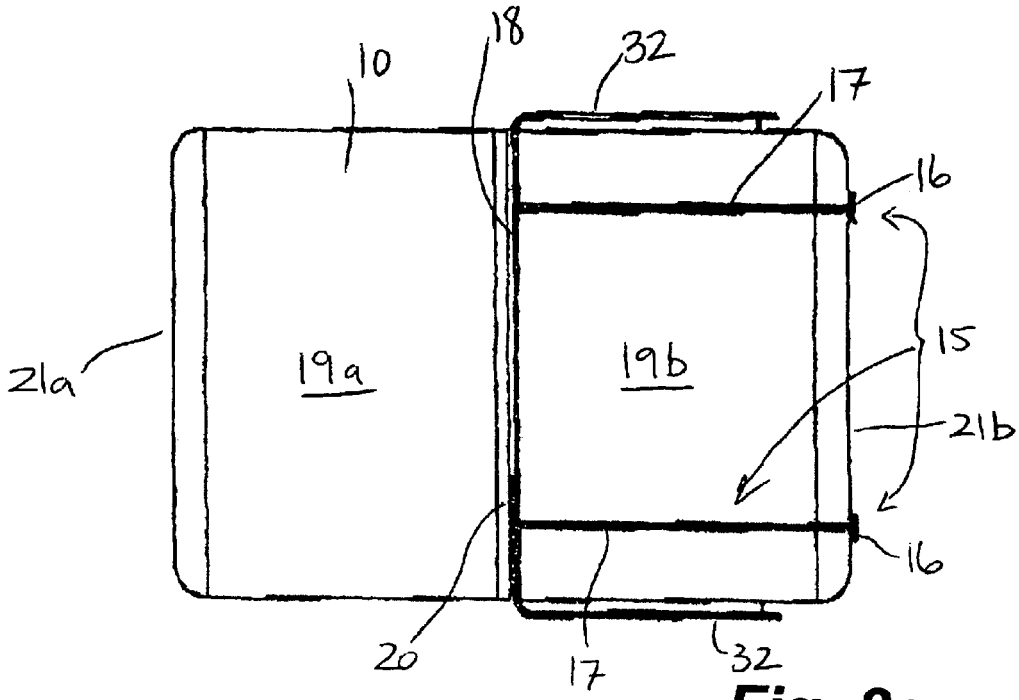
FIG. 2*a* is a top view of a tension strap and bracket embodiment of the present invention, the apparatus being adapted to a conventional cover lifting device.
Figure 2B:
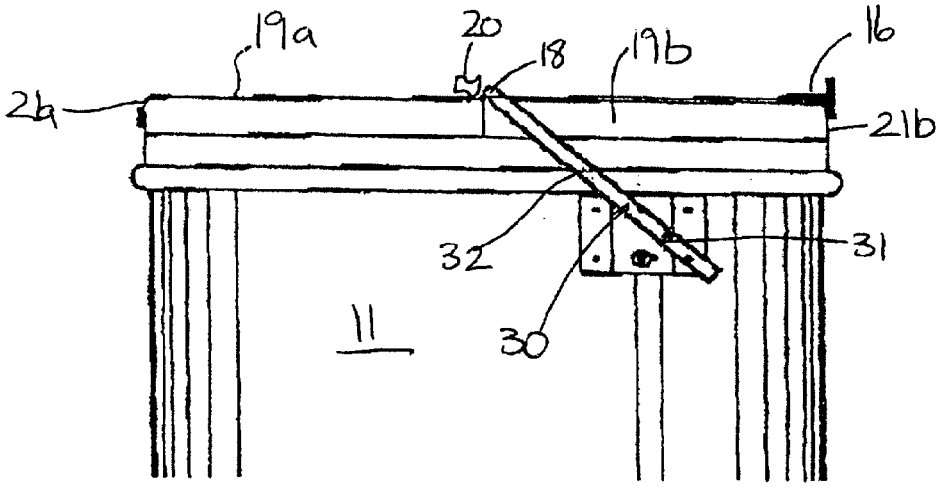
FIGS. 2*b*–2*e* are sequential views of the lifting and support of a cover having two sides according to the embodiment of FIG. 2*a*.

In FIGS. 2*a* and 2*b*, support apparatus 15 for the cover 10 comprises cover engaging means 16 adapted for connection and suspension from a structural crossbar 18 using tension means 17 which are members capable of accepting tension without substantial stretch or extension; compression capability not being required. As shown, the cover 10 has first and second planer surfaces 19*a*, 19*b* foldable about a hinge 20 and having opposing peripheral edges 21*a*,21*b* extending substantially parallel to the hinge. The engaging means 16 support the cover without imparting significant tension to the fabric of the cover.

A conventional lifting device 30 is mounted to a side of the spa 11 and rotates about a pivot 31 which is arbitrarily shown as being adjacent the second planer surface 19*b*. The crossbar 18 is supported by two side arms 32. The side arms 32 have a length sufficient so as to space the crossbar 18 away from the peripheral edge 21*b* towards and adjacent to but spaced short from the hinge 20. Accordingly, the effective length of the tension means 17 and engaging means 16 have a length shorter than the distance between the hinge 20 and the peripheral edge 21*a* or 21*b*. Tension means 17 include flexible and non-flexible members. Of the flexible members, examples include straps such as netting, polypropylene, nylon, and aircraft cable. Examples of non-flexible members can include slender rods and strapping.

Figure 2C:
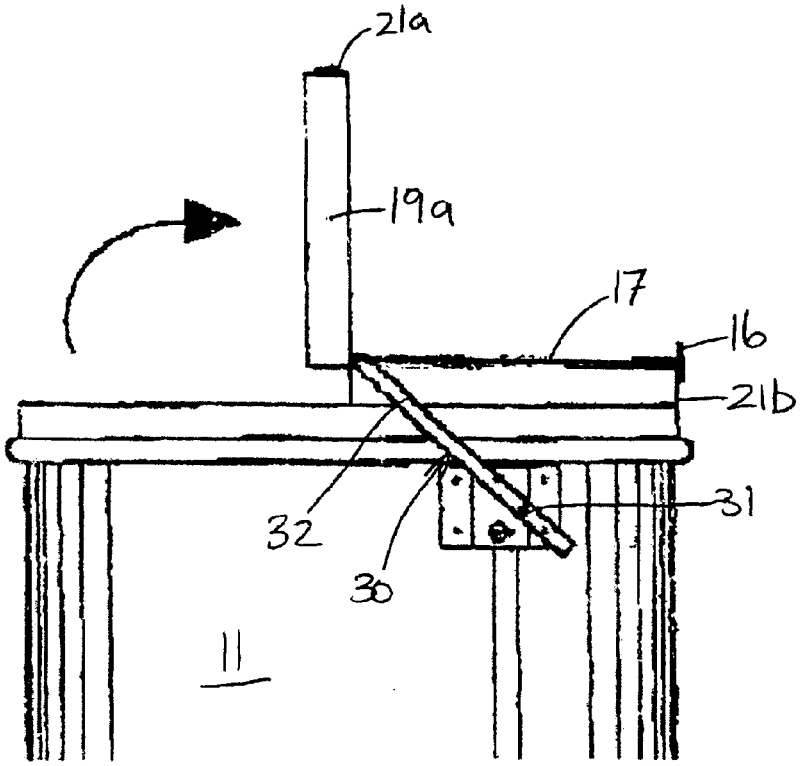
Figure 2D:
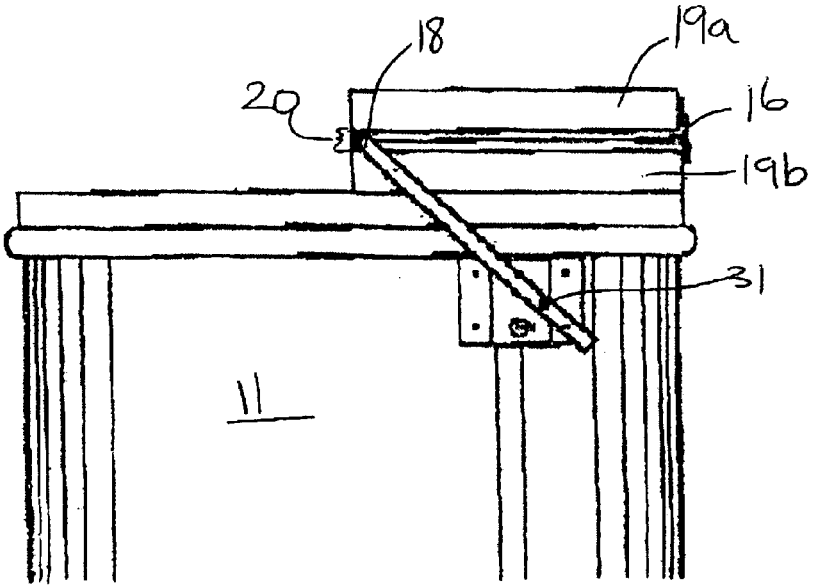
Figure 2E:
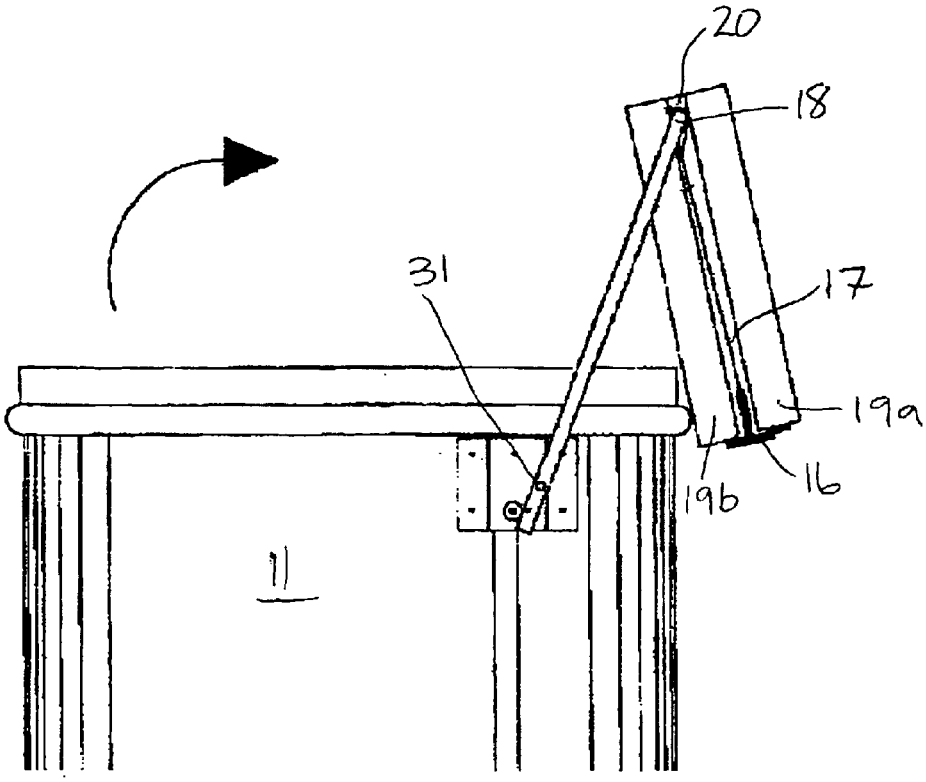

With reference to FIGS. 2*c*–2*e*, the first planer surface 19*a* folds (FIG. 2*c*) at the hinge 20 and over the crossbar 18 so that ultimately the first planer surface 19*a* lies on top of the second planer surface 19*b* (FIG. 2*d*). The crossbar 18, tension means 17 and engaging means 16 are sandwiched between the first and second planer surfaces 19*a*, 19*b*.

As shown in FIG. 2*e*, once the lifting device 30 is actuated, the cover 10 is supported by the crossbar 18. Using an embodiment of the present invention, the cover 10 is supported by the engaging means 16 at the covers peripheral edges 21*a*,21*b*. Above the engaging means 16, the weight of the cover 10 is transferred through the tension means 17 to the crossbar 18, the hinge remaining in a substantially unstressed state.

Figure 3:
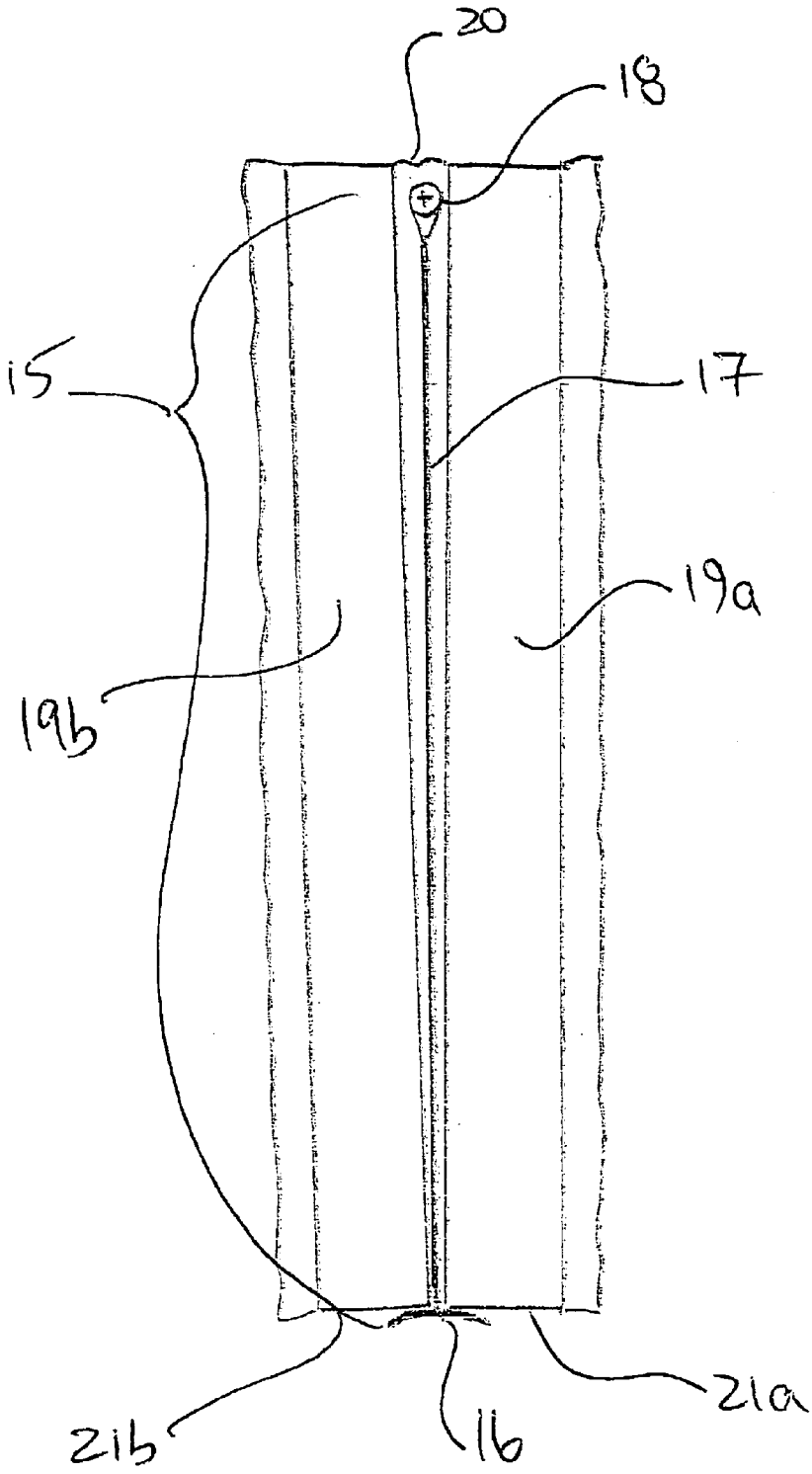
FIG. 3 is a side view of the two side of the cover of FIG. 2*e* illustrating the bracket and the tension strap and better illustrating the support of the cover without stress being imposed on the hinge.

With reference to FIG. 3, the lifter device 30 and spa 11 have been omitted for clarity illustrating, in isolation, the hanging cover 10 and support apparatus 15. The engaging means 16 bears the entire weight of the cover 10 through support of both of the cover's first and second planer surfaces 19*a*, 19*b* and the tension means 17. The tension means 17 is sandwiched between and interferes minimally with the two planer surfaces 19*a*, 19*b*.

Figure 4A:
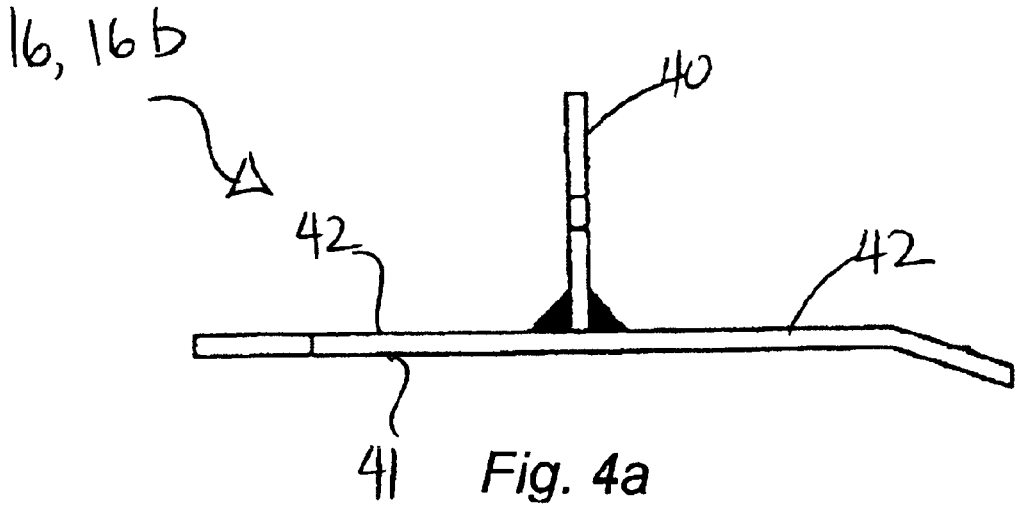
FIG. 4*a* is a side view of a bracket embodiment of the engaging means of the present invention, illustrating the tension connector and the base having angled portions.
Figure 4B:
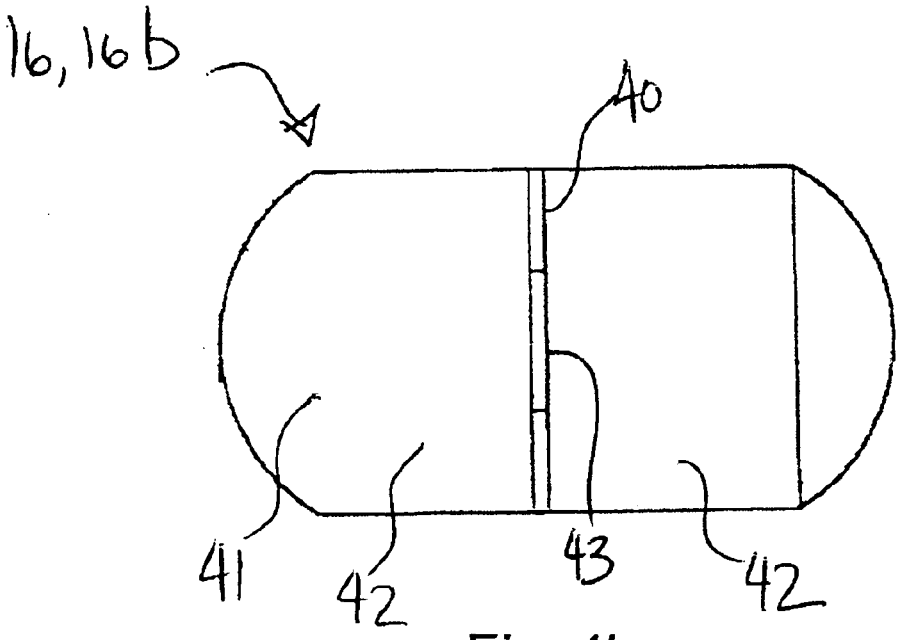
FIG. 4*b* is a top view of the bracket of FIG. 4*a;*

As shown in FIGS. 4*a*, 4*b*, in a particular embodiment, the engaging means 16 is a bracket 16*b* comprising a connecting member 40, for connection to the tension means 17, and a base 41. The base 41 has support members 42 which extend laterally from the connecting member 40. As shown and adapted to a cover having two planer surfaces, the support members 42 extend bi-laterally from each side of the connecting member 40, forming an upside down "T"-shape. The peripheral edges 21*a*,21*b* of the cover 10 are supported on the support members 42. The connecting member 40 has a port 43 for accepting a flexible tension means 17. Preferably, the bracket 16*b* is manufactured of UV resistant plastic polyurethane.

Figure 5:
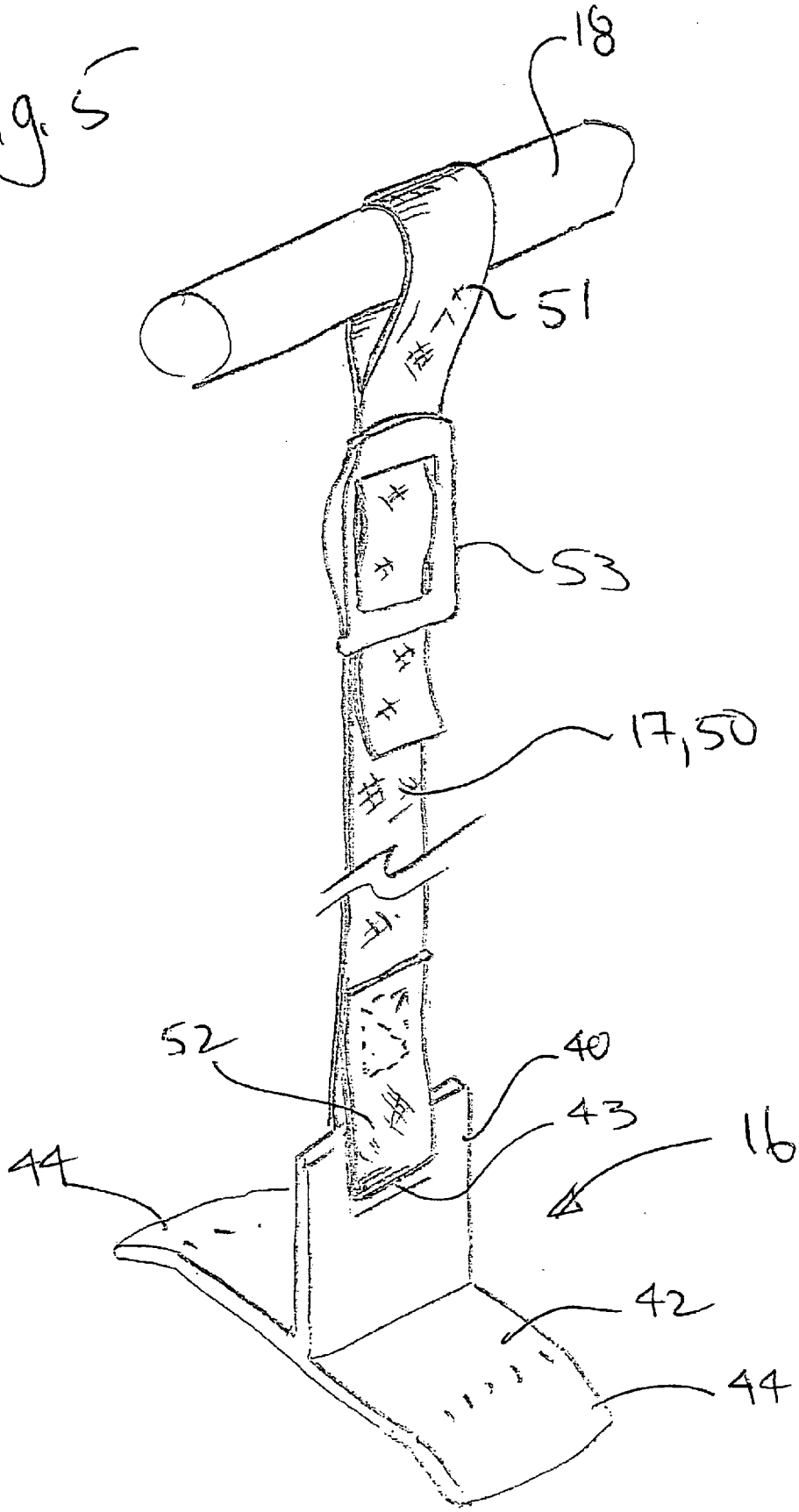
FIG. 5 is a perspective view of a tension strap and bracket according to FIG. 2*a*, 4*a*, and 4*b* illustrating a tension strap connected to a crossbar and having an adjustable length.

As shown in FIG. 5, the tension means 17 can comprise a strap 50 which connects about the crossbar 18 and aligns co-linearly with the connection member 40 through port 43 of the engaging means 16. The base 41 is preferably contoured to ensure or ease engagement of the peripheral edges 21*a*,21*b* with the support members 42,42. Distal ends 44 of the support members 42 are chamfered (not shown), or are bent away (shown) from the cover and crossbar 18 so as to minimize interference with the peripheral edge 21*a* of the cover 10 during the folding over process. Other embodiments of the engaging means 16 are shown in FIGS. 9*a*–9*c*. In FIG. 9*a*, distal ends 44 of the bracket 16*b* are not bent away. In FIG. 9*b*, the base 41 has one bent away distal end 44, and in FIG. 9*c*, each distal end 44 of the base 41 is bent away.

Figure 6A:
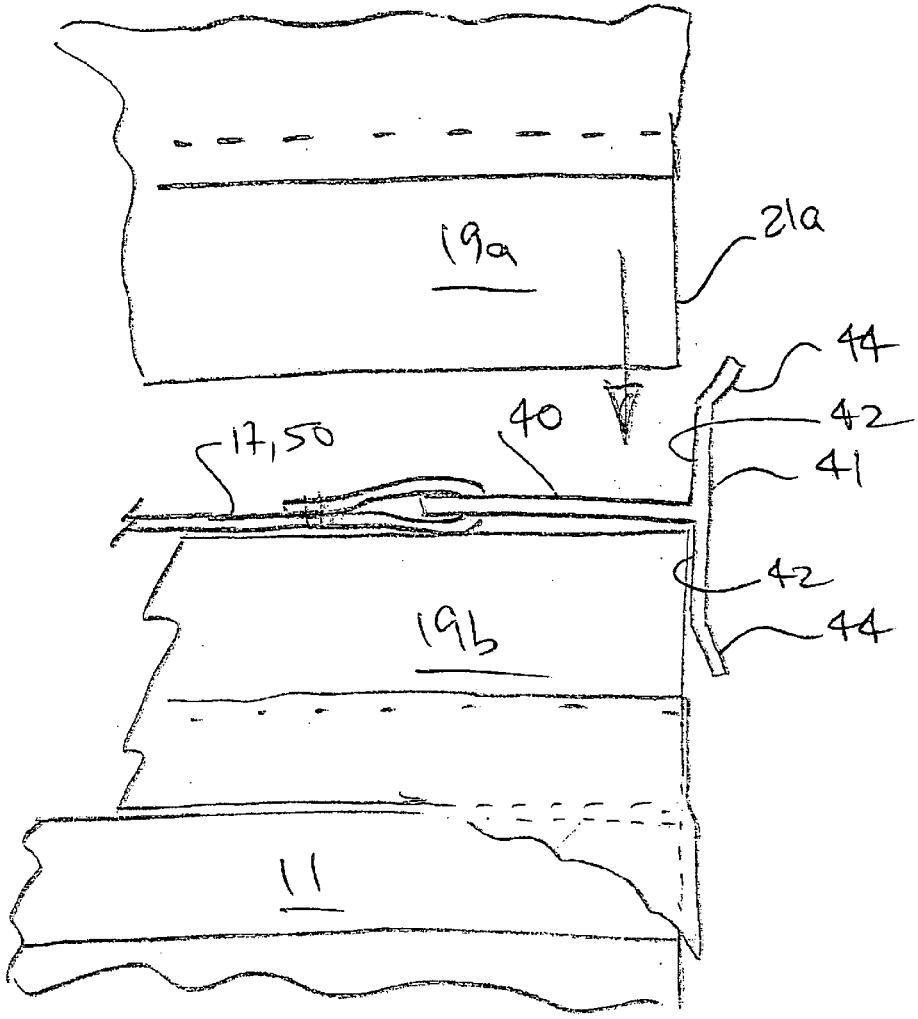
FIG. 6*a* is a dose up partial side view of the bracket according to FIG. 2*d*, just prior to the two sides being folded and illustrating the interaction of the sides peripheral edges and the bracket.
Figure 6B:
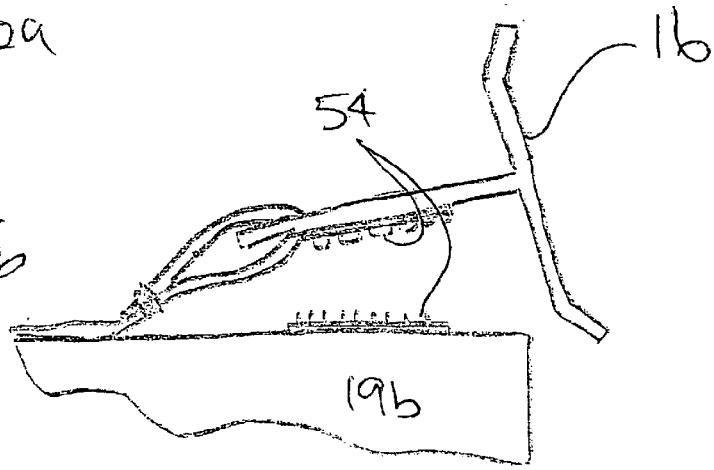
FIG. 6*b* is a close up of another embodiment of a bracket which is optionally and releasably secured to one side of the cover.

In another embodiment, shown in FIG. 6, the tension means 17 or engaging means 16 are restrained from being accidentally displaced prior to and during use through an optional releasable connector 54 to one of the planer surfaces 19*a*, 19*b*. Such a releasable connector 54 is a hook and loop fastener.

Preferably, the tension means 17 is a strap 50 having a first end 51 which connects around the crossbar 18 and a second end 52 which connects to the port 43 in the engaging means 16. For adjusting the length of the strap 50 and thus adjusting the relative position of the hinge 20 and the crossbar 18, means such as a buckle 53 is positioned intermediate the ends 51,52. The buckle enables adjustment of the length of the strap 50 so as to adjust for an aged or relaxed strap 50 or so that the same apparatus can be utilized for covers 10 of different size.

The tension means 17 (such as straps 50) and engaging means 16 (such as brackets 16*b*) can be provided as a kit to retrofit existing covers and cover lifters before the cover 10 is damaged or as a new component for use with new lifters and spas.

Figure 7A:
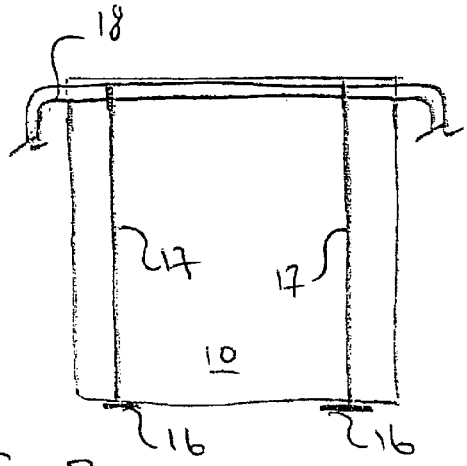
FIGS. 7*a*-7*d* are several alternate embodiments of the tension means and engaging means including two pairs of tension and engaging means, two tension means and one engaging means; a mesh style tensions means and two pair of tension and engaging means at the lateral edges of cover respectively. For covers having folded planer surfaces, one has been omitted for clarity.
Figure 7B:
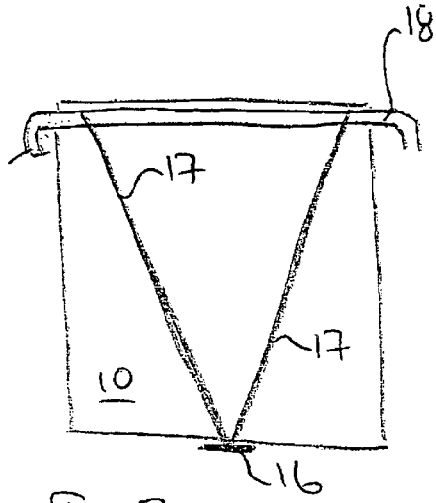
Figure 7C:
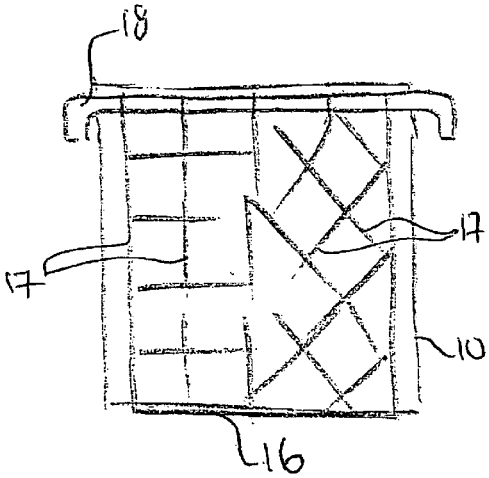
Figure 7D:
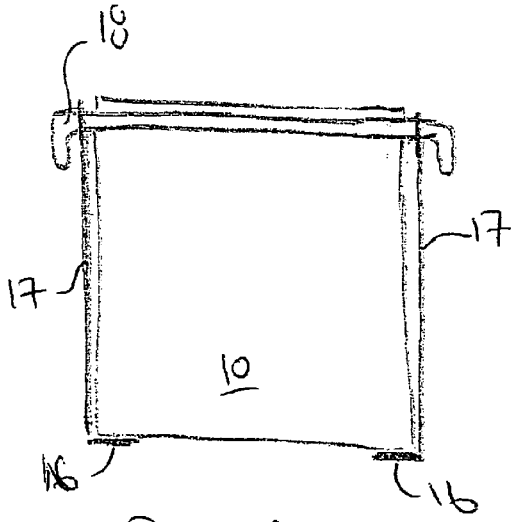

Turning to FIGS. 7*a*–7*d*, several alternate embodiments are illustrated. At least one engaging means 16 is illustrated in each embodiment. Further, at least one tension means 17 is provided, numbering at least one per engaging means 16. Two or more tension means 17 are spaced along the crossbar 18 for distributing the load therealong. In FIG. 7*a*, the tension means 17 and engaging means 16 include two pairs of tension 17, 17 and engaging means 16, 16 spaced along the crossbar 18 and are similar to the embodiment set forth in FIGS. 2*a*–2*e*. In FIG. 7*b*, two tension means 17, 17 extend diagonally to a single engaging means 16. In FIG. 7*c* a netting or mesh-style tension means 17 (with alternate mesh styles shown) transfers tension from one or more engaging means 16, 16. In FIG. 7*d*, two pairs of tension means 17, 17 and engaging means 16, 16 are positioned at distal ends of the crossbar 18 and transverse edges of the cover for positioning the engaging means at the transverse edges of the peripheral sides 21*a* or 21*b* of the cover 10.

Figure 8A:
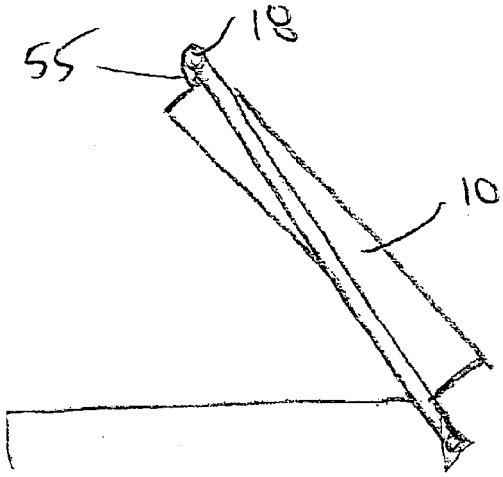
Fig 8a PRIOR ART

In FIGS. 8*a* and 8*b*, a prior art arrangement of a single planer surface cover 10 is illustrated with a loop 55 or sleeve type fabric support acting as a means for hanging the cover from a crossbar 18. The loop 55 and its connection to the cover are under significant stress.

Figure 8C:
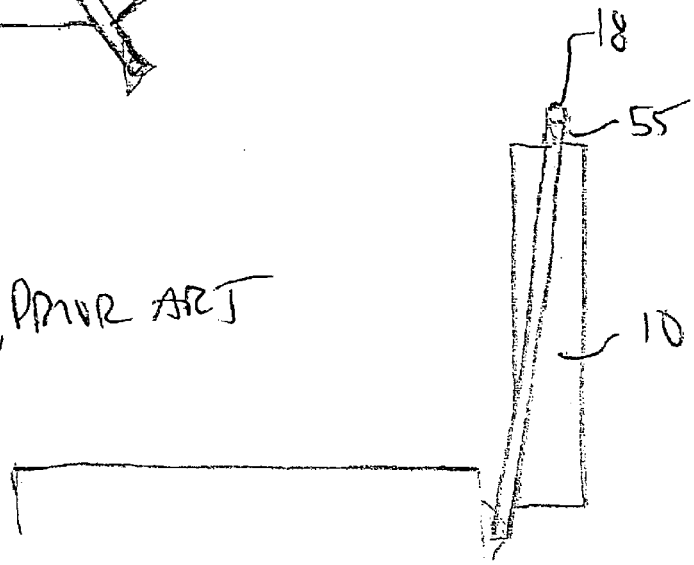
FIG. 8*c* is an embodiment of the present invention adapted to the crossbar and single side planer cover of FIGS. 8*a* and 8*b*.
Figure 8C:
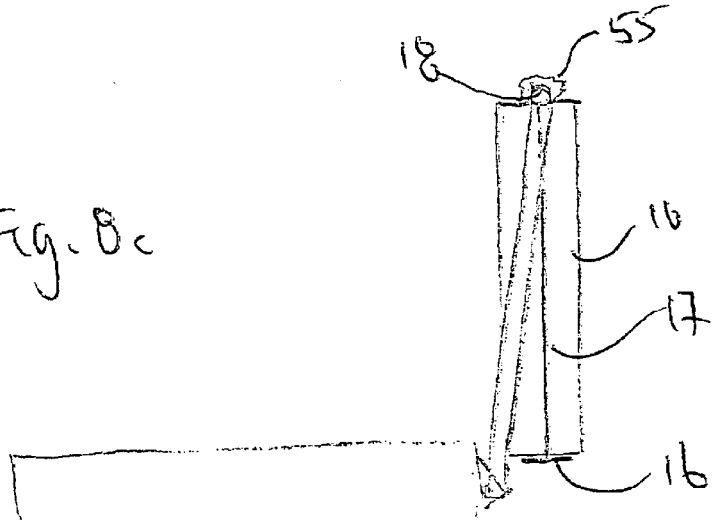

As shown in FIG. 8*c*, applying an embodiment of the present invention, the cover is supported using an engaging means 16 and tension means 17 with the result that the loop 55 is under little or no stress when the cover is supported. Preferably the tension means 17 is positioned at the distal ends of the crossbar 18 (such as in the embodiment of FIG. 7*d*), or extends through the cover for connection to the crossbar 18.

Stress is removed from the stitching in the spa cover hinge by providing support to a cover or to both sides of a folding cover through tension means which extend to engage the cover from below and thereby enabling support of the weight of the cover in compression and not through tension to the cover, thereby increasing the life expectancy of the spa cover. This apparatus is simple and easy to use. The apparatus is also non-invasive to the spa, or the spa cover. The straps and brackets are easy to install, low cost, adjustable and can be used with existing lifting devices incorporating a crossbar and side arms.

The embodiments of the invention in which an exclusive property or privilege is being claimed are detailed as follows:

1. In an apparatus for supporting a cover suspended over a crossbar, the cover having first and second planer surfaces foldable about a hinge and opposing peripheral edges spaced from and extending substantially parallel to the hinge, the planer surfaces sandwiching the crossbar therebetween when folded with the peripheral edges oriented substantially together and below the crossbar when supported, said improvement comprising:

engaging means supporting and engaging the peripheral edges; and tension means, connected between the crossbar and the engaging means and being sandwiched between the first and second planer surfaces supporting the cover with the hinge spaced above the wherein the hinge is and in a substantially stress free state, wherein the crossbar is part of a cover lifter, the crossbar extending transversely between arms rotatable about pivots between a resting position and a supporting position, and wherein, in the resting position, the crossbar is positioned on one of the first and second planer surfaces, substantially adjacent and parallel to the hinge and intermediate the hinge and the peripheral edge of the one of the first and second planer surfaces, and in the supporting position, the crossbar is sandwiched between the first and second planer surfaces and the hinge is positioned above the crossbar.

2. The apparatus of claim 1 wherein the tension means further comprises one or more tension means, each tension means having:

a first end connected to the crossbar, and a second end connected to the engaging means.

3. The apparatus of claim 1 wherein the tension means has a length for spacing the hinge above the crossbar when the cover is supported.

4. The apparatus of claim 3 wherein the tension means further comprises adjusting means for varying the length of the tension means for adjusting the distance between the engaging means and the crossbar for adjusting the spacing of the hinge above the crossbar.

5. The apparatus of claim 1 wherein the engaging means comprise one or more brackets having support members extending bi-laterally from the tension means for engaging the peripheral edges of the cover.

6. The apparatus of claim 1 wherein the tension means is a flexible strap and the engaging means is a 'T'-shaped bracket, further comprising:

two or more brackets; and two or more straps, one strap per bracket.

7. The apparatus of claim 6 where the bracket is manufactured of UV resistant plastic polyurethane.

8. The apparatus of claim 6 further wherein two straps are spaced along the crossbar.

9. The apparatus of claim 1 where said tension means have a length which is adjustable.

10. The apparatus of claim 1 where said engaging means is a bracket comprising:

a connection member for connecting to the tension means and aligning co-linearly therewith; and a base extending laterally from the connection member for engaging the peripheral edges of the cover.

11. The apparatus of claim 10 wherein the base of the bracket comprises support members extending bi-laterally from either side of the connection member for forming a "T"-shape so as to support first and second planer surfaces of the cover.

12. The apparatus of claim 11 wherein the support members have at least one distal end bent away from the cover so as to minimize interference with the peripheral edges of the cover.

13. The support apparatus of claim 1 where the engaging means is removeably affixed to the cover.

14. The support apparatus of claim 13 where the engaging means is removeably affixed to the cover with a hook and loop type fastener.

15. The support apparatus of claim 1 wherein the engaging means comprises two or more brackets, each bracket having a corresponding tension means spaced adjacent distal ends of the cover lifter.

16. In an apparatus for supporting a planer cover hanging from a crossbar, the cover having first and second planer surfaces being normally suspended by a fabric connection to the crossbar, the cover having peripheral edges hanging below the fabric connection, the improvement comprising:

one or more brackets engaging the peripheral edges;

one or more tension means, connected between the crossbar and the engaging means and being sandwiched between the first and second planer surfaces, supporting the cover while the fabric connection spaced above the crossbar wherein the fabric connection is in a substantially stress free state, wherein the crossbar is part of a cover lifter, the crossbar extending transversely between arms rotatable about pivots between a resting position and a supporting position, and wherein, in the resting position, the crossbar is positioned on one of the first and second planer surfaces, substantially adjacent and parallel to the fabric connection and intermediate the fabric connection and the peripheral edge of the one of the first and second planer surfaces, and in the supporting position, the crossbar is sandwiched between the first and second planer surfaces and the fabric connection is positioned above the crossbar.

* * * * *